US005709118A

United States Patent [19]

Ohkubo

[11] Patent Number: 5,709,118

[45] Date of Patent: Jan. 20, 1998

[54] PRESS APPARATUS FOR FORMING GEAR TEETH

[75] Inventor: Mamoru Ohkubo, Neyagawa, Japan

[73] Assignee: Exedy Corporation, Osaka, Japan

[21] Appl. No.: 659,851

[22] Filed: Jun. 7, 1996

[30] Foreign Application Priority Data

Jun. 13, 1995 [JP] Japan ..... 7-145954

[51] Int. Cl.[6] ..... B21D 9/08; B21D 15/00; B21D 17/10

[52] U.S. Cl. ..... 72/213; 72/207; 72/208

[58] Field of Search ..... 72/207, 208, 212, 72/213, 178

[56] References Cited

U.S. PATENT DOCUMENTS 3,729,970 5/1973 Propach et al. ..... 72/208

FOREIGN PATENT DOCUMENTS 2484483 11/1981 France ..... 72/212
20 17 709 11/1971 Germany .
28 29 041 1/1980 Germany .

*Primary Examiner*—Lowell A. Larson
*Assistant Examiner*—Rodney A. Butler
*Attorney, Agent, or Firm*—Shinyu Office of Patent Attorney

[57] ABSTRACT

A gear teeth forming apparatus is used for forming a plurality of gear teeth on an outer circumferential wall of a pressed drum. The apparatus includes a punch and a plurality of rotational rollers. A plurality of convex/concave portions are formed in the axial direction on the punch. The punch has an outer circumferential surface on which the outer circumferential wall of the pressed drum is fitted. Also, the punch is movable in the axial direction. A plurality of the rotational rollers are insertable partially into grooves of the punch and are rotatable along the grooves.

1 Claim, 2 Drawing Sheets

PRESS APPARATUS FOR FORMING GEAR TEETH

BACKGROUND OF THE INVENTION

A. Field of the Invention

The present invention relates to a gear teeth forming apparatus, and more particularly to an apparatus for forming a plurality of gear teeth which extend in an axial direction on an outer circumferential wall of a cylindrically shaped member.

B. Description of Related Art

In some applications, a drum used in a clutch assembly is often provided with a plurality of gear teeth which extend axially on an outer surface of the drum. Spline teeth of a drive plate or a driven plate in the clutch typically engage the gear teeth formed in the drum so that the plate is movable in an axial direction with respect to the drum but is engaged with the formed gear teeth on the drum for rotation with the drum.

There are many devices that form gear teeth on a drum or a metallic blank. For instance, bobbers are well known for systematically scrapping portions of a metal blank away to form gear teeth. Hobbers typically machine metal ridges in a metallic blank to form the gear teeth. There are also machines which use a cam for indexing a gear shaping tool to form gear teeth. Further, there are also cold rolling devices which use dies and, under pressure, deform a metallic blank to form gear teeth. Such cold rolling devices are often bulky and require repeated motion to deform the blank to form gear teeth.

Hobbers and cam operated devices use gear cutting tools that are too large in physical dimensions to adequately form the teeth desired on a drum in a small clutch assembly. Further, after using the cutting process which forms the gear teeth, typically a surface hardening technique must be employed to harden the gear teeth to improve wear. Therefore, the overall process is complicated and costly. Furthermore, in many other gear forming methods, the apparatus required for the gear forming operation is large and cumbersome.

SUMMARY OF THE INVENTION

An object of the present invention is to provide a gear teeth forming apparatus for a drum with a simple structure and which facilitates a simple process for producing the required gear teeth.

In one aspect of the present invention, a gear teeth forming apparatus for forming a plurality of gear teeth extending in an axial direction on an outer circumferential wall of a cylindrically shaped member includes a base member and a punch disposed above the base member, the punch supported on the base member by elastic elements movable in the axial direction, the punch formed with a plurality of grooves on an outer circumferential surface thereof. The apparatus also includes a plurality of rollers supported on the base and freely rotatable with respect to the base, the rollers disposed adjacent to the outer circumferential surface of the punch, each of the rollers disposed adjacent to a corresponding one of the grooves. The punch is configured to move downwardly from an upper position to a lower position such that in the lower position, the rollers circumferentially surround the punch and in the upper position the punch is above and spaced apart from the rollers.

Preferably, the gear teeth forming apparatus includes an annular backup ring supported on the base which contacts a radial outer side of each of the rollers.

Preferably, the annular backup ring is configured for axial movement above an upper surface of the base.

Preferably, the base is formed with a plurality of circumferentially spaced apart apertures and a plurality of slide members are attached to the base, each of the slide members having a slide rod at least partially extending there from, each of the slide rods being freely extendable from the slide members such that the slide rods extend through the apertures in the base, and each of the slide rods being fixed to the annular backup ring, thus supporting the backup ring.

In accordance with another aspect of the invention, a method for forming gear teeth on a cylindrically shaped member includes the steps of:

positioning a cylindrically shaped member on a punch that is configured for axial movement together with the cylindrically shaped member, the punch further being formed with a plurality of axially extending grooves;

applying force to the cylindrically shaped member and the punch thus urging them into contact with a plurality of circumferentially spaced apart rollers such that each of the rollers urge a corresponding portion of the cylindrically shaped member into a corresponding groove in the punch, thus deforming that portion of the cylindrically shaped member.

In the above method, it is preferable that, in response to the step of applying force to the cylindrically shaped member and the punch, the cylindrically shaped member is urged between the rollers and the punch thus deforming portions of the cylindrically shaped member and the rollers roll against the surface of the cylindrically shaped member, an annular ring in contact with the rollers moves in a direction opposite the movement of the cylindrically shaped member in response to rolling movement of the rollers, the annular ring providing circumferential support to the rollers.

In yet another aspect of the invention, an apparatus for forming gear teeth on a cylindrically shaped member includes a base member, a punch that is configured for axial movement together with a cylindrically shaped member, the punch further being formed with a plurality of axially extending grooves, and a plurality of circumferentially spaced apart rollers supported on the base, the rollers being configured such that each of the rollers urge a corresponding portion of the cylindrically shaped member into a corresponding groove in the punch, thus deforming that portion of the cylindrically shaped member.

Preferably, the apparatus also includes an annular ring supported by the base wherein in response to movement of the cylindrically shape member and the punch, the cylindrically shaped member is urged between the rollers and the punch thus deforming portions of the cylindrically shaped member and the rollers roll against the surface of the cylindrically shaped member, and the annular ring being in contact with the rollers moves in a direction opposite the movement of the cylindrically shaped member in response to rolling movement of the rollers, the annular ring providing circumferential support to the rollers.

In the gear teeth forming apparatus, a plurality of the gear teeth are formed in the outer circumferential wall of a drum. Here, the gear teeth are attained by a simple press machine having a punch or the like. Also, since the working process is performed through one stroke, the number of the working steps may be reduced.

In the gear teeth forming apparatus, the outer circumferential wall of the pressed drum is depressed to each of the recess portions of the punch by a plurality of the rollers arranged radially outwardly of the punch. Thus, the gear teeth are attained.

In the gear teeth forming apparatus of the invention, although a radially outward force is applied to a plurality of the rollers while forming the gear teeth, radially outward that force is counteracted against by the annular backup ring. Thus, the rollers are confined and do not move in a radially outward direction and the gear teeth are formed in a regular or normal manner.

In the gear teeth forming apparatus of the invention, during the formation of teeth, the annular backup ring moves in a direction opposite to the movement direction of the punch. As a result, there is little friction or resistance between the rollers and the annular backup ring and the rollers may rotate smoothly.

DESCRIPTION OF THE PREFERRED EMBODIMENTS

The present invention will now be described with reference to the accompanying drawings.

Figure 1:
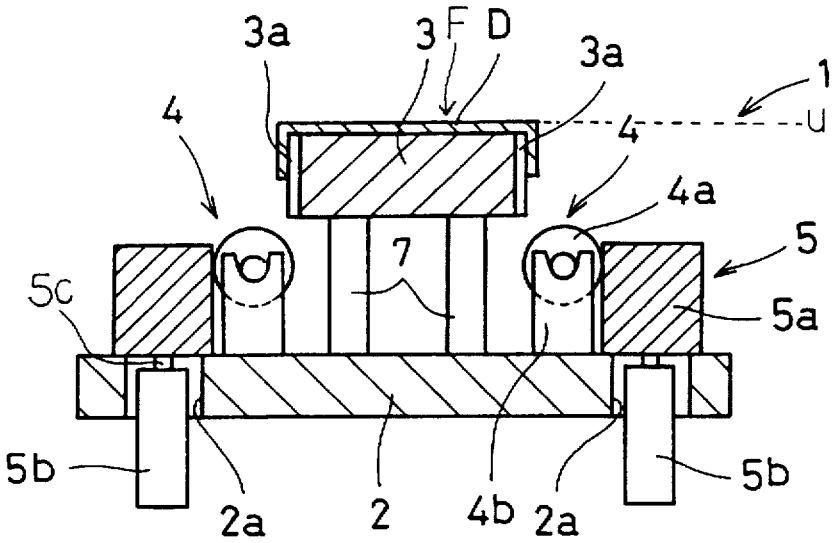
FIG. 1 is a schematic, cross-sectional side view of a gear tooth forming apparatus in accordance with one embodiment of the present invention.
Figure 2:
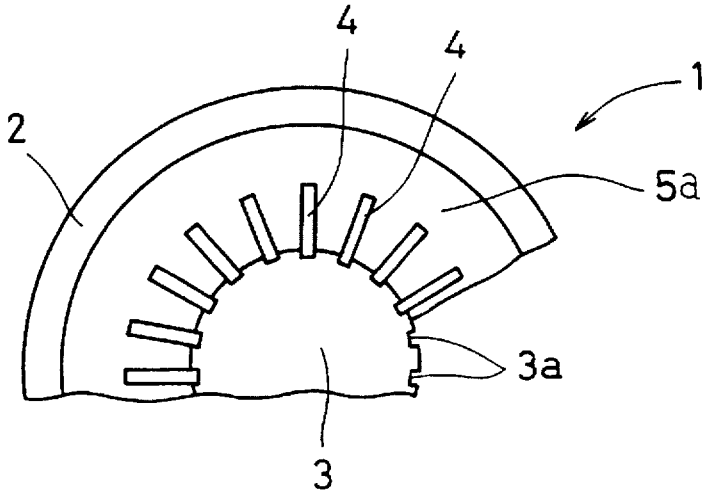
FIG. 2 is a fragmentary top elevational view showing the gear tooth forming apparatus depicted in FIG. 1.
Figure 3:
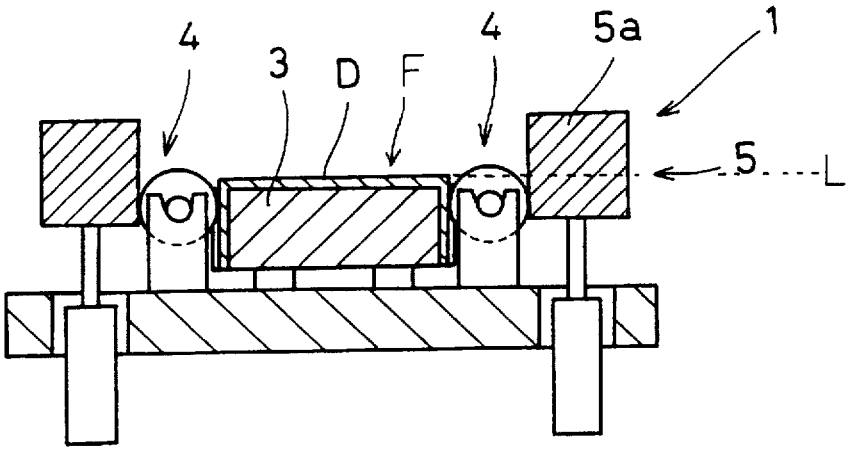
FIG. 3 is a view similar to the view of FIG. 1, showing a gear tooth forming operation as performed by the gear tooth forming apparatus shown in FIG. 1.

FIGS. 1, 2 and 3 show a gear tooth forming apparatus 1 according to one embodiment of the invention. The gear teeth forming apparatus 1 includes a base 2, a punch 3, a roller mechanism 4 and a load receiving mechanism 5. The base 2 is formed with a disc-like shape and is formed with a plurality of holes 2*a*. The holes 2*a* are circumferentially spaced apart from one another at equidistant intervals in the circumferential direction on an outer circumferential side of the base 2. The punch 3 is a disc-shaped member and is centrally disposed above the upper surface of the base 2. Springs 7 are interposed between the punch 3 and the base 2, so that the punch 3 is movable up and down on the base 2. The springs 7 are provided to bias the punch 3 in an upper position U, as shown in FIG. 1. Furthermore, the punch 3 is configured to be moved downward by a force F from above (in FIG. 1) and moved to a lower position L, as shown in FIG. 3. A plurality of grooves 3*a* are formed on the outer circumference of the punch 3 and are sized an configured to form any of a variety of predetermined gear shapes and gear forms, depending upon the desired results.

The roller mechanism 4 includes a plurality of rotational rollers 4*a* disposed radially outwardly from the punch 3. Each of the rollers 4*a* is supported on a support base 4*b*. Each of the rollers 4*a* may include a bearing (not shown) so that the rollers 4*a* may rotate freely on the support base 4*b*. The support base 4*b* is fixed to the base 2, and the rotational rollers 4*a* are positioned such that they are aligned with the grooves 3*a* of the punch 3.

The load receiving mechanism 5 includes a backup ring 5*a* and a plurality of side receiving member 5*b* for supporting the backup ring 5*a* from below. Each of the slide receiving members 5*b* may be fixed to the base 2 or, alternatively, both the base 2 and the slide receiving members 5*b* may be fixed to a separate base member (not shown). Each of the slide receiving members 5*b* includes a sliding rod 5*c* which is freely slidable in and extendable from its corresponding slide receiving member 5*b*. Each of the slide receiving members 5*b* extends through the holes 2*a* of the base 2 so that each of the sliding rods 5*c* may extend through a corresponding hole 2*a*. The backup ring 5*a* is fixed to each of the sliding rods 5*c*. The inner circumferential surface of the backup ring 5*a* is sized and configured to be in contact with each of the rotational rollers 4*a*. The slide receiving members 5*b* are thus configured to supporting the backup ring 5*a* to be movable up and down with respect to the base 2.

A pressed drum D, which is to have gear teeth formed thereon, is set as shown in FIG. 1 on to the punch 3. Specifically, the outer circumferential wall of the drum D is fitted over the outer circumferential surface of the punch 3 thus extending over the grooves 3*a*. When a large force, such as the force F, is applied to the drum D and punch 3 from above, the punch 3 and drum D are moved downward with the drum D. The movement of the drum D downward causes the outer circumference of the drum to contact the rotational rollers 4*a*. Contact with the rotational rollers 4*a* causes the rotational rollers 4*a* to rotate and further, causing the drum D to be deformed as the rotation rollers 4*a* force corresponding portions of the outer circumferential wall of the drum D to into the grooves 3*a* of the punch 3. As a result, a plurality of gear teeth are formed in the pressed drum D to be machined. While the drum D is moving downward and gear teeth are formed thereon, the backup ring 5*a* of the load receiving mechanism 5 is moved upward due to contact with the rolling rotational rollers 4*a*. In other words, the backup ring 5*a* moves in response to rotation of the rotational rollers 4*a*. The backup ring 5*a* provides support to the rotational rollers 4*a*, preventing radial outward movement of the rotational rollers 4*a*. Since the backup ring 5*a* is freely movable up and down, there is little possibility that friction or resistance will be created which might hinder the rolling movement of the rotational rollers 4*a* and the backup ring 5*a*.

In the gear teeth forming apparatus 1, the gear teeth may be formed with a simple pressing machine including the punch 3 and the like. Also, since the working process is performed through one stroke, the number of the working steps may be reduced.

In the gear teeth forming apparatus for a pressed drum according to the present invention, the gear teeth may be formed with a simple pressing machine including the punch and the like. Also, since the working process is performed through one stroke, the number of the working steps may be reduced.

Various details of the invention may be changed without departing from its spirit nor its scope. Furthermore, the foregoing description of the single embodiment according to the present invention is provided for the purpose of illustration only, and not for the purpose of limiting the invention. The invention may be defined suitably by the appended claims and may include possible equivalent thereof.

What we claim is:

1. A gear teeth forming apparatus for forming a plurality of gear teeth extending in an axial direction on an outer circumferential wall of a cylindrically shaped member comprising;

a base member, said base formed with a plurality of circumferentially spaced apart apertures at equidistant intervals in the circumferential direction on an outer circumferential side of said base;

a punch disposed above said base member, said punch supported on said base member by elastic elements movable in the axial direction, said punch formed with a plurality of grooves on an outer circumferential surface thereof; and a plurality of rollers supported on said base and freely rotatable with respect to said base, said rollers disposed adjacent to said outer circumferential surface of said punch, each of said rollers disposed adjacent to a corresponding one of said grooves;

an annular backup ring supported on said base which contacts a radial outer side of each of said rollers, said annular backup ring is configured for axial movement above an upper surface of said base;

a plurality of slide members attached to said base, each of said slide members having a slide rod at least partially extending there from, each of said slide rods being freely extendable from said slide members such that said slide rods extend through said apertures in said base, and each of said slide rods being fixed to said annular backup ring, thus supporting said backup ring during axial movement above said upper surface of said base;

wherein said punch is configured to move downwardly from an upper position to a lower position such that in said lower position, said rollers circumferentially surround said punch and in said upper position said punch is above and spaced apart from said rollers, and where engagement of said rollers with said cylindrically shaped member causes spinning movement of said rollers such that when said annular backup ring contacts the radial outer side of each of said rollers, said rollers causes said annular backup ring to move in an upward direction.

* * * * *